United States Patent [19]

Esry et al.

[11] 4,079,380

[45] Mar. 14, 1978

[54] NULL STEERING APPARATUS FOR A MULTIPLE ANTENNA ARRAY ON AN FM RECEIVER

[75] Inventors: Jack W. Esry; Gregory H. Piesinger, both of Scottsdale, Ark.

[73] Assignee: Motorola, Inc., Schaumburg, Ill.

[21] Appl. No.: 744,009

[22] Filed: Nov. 22, 1976

[51] Int. Cl.[2] ..... H01Q 3/26

[52] U.S. Cl. ..... 343/100 SA; 343/100 CL; 343/100 LE; 343/854

[58] Field of Search ..... 343/100 SA, 100 LE, 343/100 CL, 854

[56] References Cited

U.S. PATENT DOCUMENTS

| | | | |
|---|---|---|---|
| 3,670,335 | 6/1972 | Hirsch | 343/100 SA |
| 3,763,490 | 10/1973 | Hadley et al. | 343/100 LE X |
| 4,032,922 | 6/1977 | Provencher | 343/100 SA X |

*Primary Examiner*—Maynard R. Wilbur
*Assistant Examiner*—Richard E. Berger
*Attorney, Agent, or Firm*—Eugene A. Parsons

[57] ABSTRACT

Null steering apparatus in a multiple antenna array including means associated with each antenna for separating signals therefrom into in-phase and quadrature components which can be adjusted so that unwanted signals from the array are cancelled and further including circuitry for separating an identifier signal, which is a low level signal substantially in-phase with the carrier, to produce a reference signal which is substracted from signals in the feedback loop of the null steering apparatus to form a lobe in the antenna pattern in the direction of the carrier modulated with the FM signal. In the transmitter, the FM modulation is periodically blanked for a short period of time so that only the carrier modulated with the identifier signal is transmitted and the feedback loop of the null steering apparatus is only activated during the blanking periods with the null steering apparatus maintaining the status quo between blanking periods.

5 Claims, 8 Drawing Figures

FIG. 3
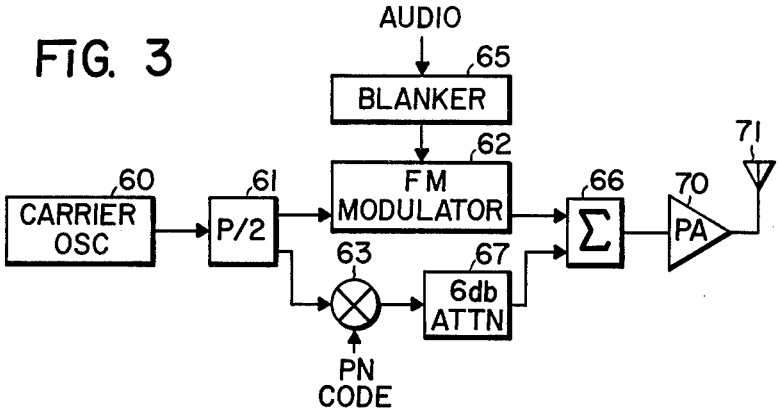
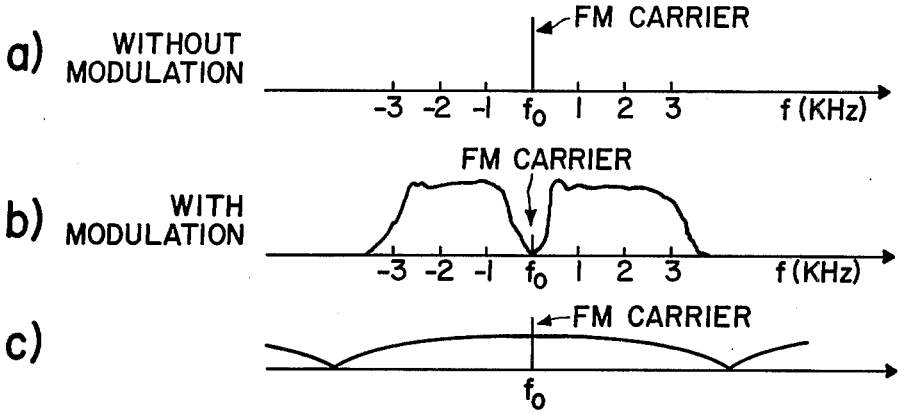
FIG. 4
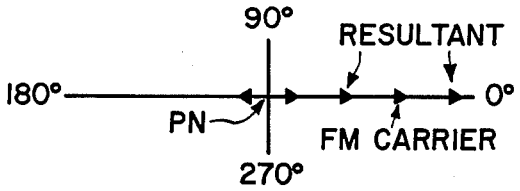
FIG. 5
FIG. 6
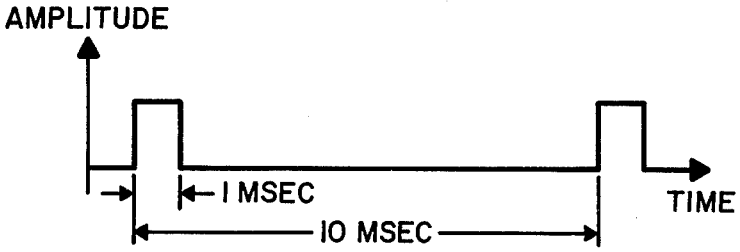

NULL STEERING APPARATUS FOR A MULTIPLE ANTENNA ARRAY ON AN FM RECEIVER

BACKGROUND OF THE INVENTION

Null steering or adaptive noise cancelling is a procedure which has been known for many years and is described, for example, in such typical articles as "Adaptive Antenna Systems," by B. Widrow et al., Proceedings of the IEEE, Vol. 55, No. 12, December 1967, and "Adaptive Noise Cancelling: Principles and Applications," by B. Widrow et al., Proceedings of the IEEE, Vol. 63, No. 12, December 1975. In general, null steering is a technique whereby two or more antenna signals are weighted and summed together to form a composite antenna pattern. The pattern is formed in such a manner as to create antenna pattern nulls in the direction of the jamming signals and lobes in the direction of desired signals. Using null steering techniques, nulls on the order of 50dB can be automatically steered in the direction of a jamming signal.

Using, for example, a four channel null steerer, each antenna signal is split into an in-phase component and a quadrature component with a 90° hybrid circuit or the like. The two signal components are then weighted and summed together along with the signal components from the other antenna weighters, in a final summing circuit. By using a 90° hybrid circuit and weighters, a single phasor (any specific signal on an antenna can be represented by a phasor) on a particular antenna can be shifted to any new phase and amplitude desired. If a jamming signal, or any other undesired signal, is present on two antennas, for example, the null steerer will shift the two signals (phasors) such that they are of equal amplitude and opposite phase. When these two weighted signals are then summed together in the final summing circuit, they will cancel, thereby forming an antenna pattern null in the direction of the jamming signal. The process is similar when the jamming signal is present on all four antennas. The number of independent nulls that can be formed is equal to N-7 where N is the number of antennas The values of the weighters are automatically adjusted by feeding back the output of the final summing circuit to a correlator or mixer, which mixes the output with each of the signal components from the antenna, which is nonweighted, thereby creating a correlation voltage. This correlation voltage is integrated and used to drive the specific weighter for that antenna component. The weighters are always driven in such a manner as to minimize the feedback signal. When the feedback signal is completely eliminated, corresponding to forming a complete null, the output of the correlator is zero and the system has fully adapted. A null steerer implemented in this manner will null out all signals as long as the number of signals is equal to or less than N-1.

To prevent nulling of desired signals, a reference signal must be used. Any prior art null steering systems which utilize a reference, simply insert an estimate of the desired signal. This reference, or estimated signal, is then used to subtract off the desired signal present at the output of the final summing circuit, thereby, preventing it from being fed back to the correlators. If the estimated signal differs from the desired signal in phase or content, a null will also be formed in the direction of the desired signal and the desired signal will be lost. Thus, it is essential that the reference signal be extremely accurate.

SUMMARY OF THE INVENTION

The present invention pertains to null steering apparatus in a multiple antenna array wherein a carrier signal having modulated thereon an FM signal and a relatively low level identifier signal substantially in-phase with the carrier signal are transmitted, with the FM modulating signal being periodically blanked for a relatively short period so that only the carrier signal modulated with the identifier signal is transmitted during the blanking periods, the identifier signal is separated from the desired signal in the null steering apparatus and utilized to produce a reference signal substantially the same frequency and phase as the carrier signal, which reference signal is utilized, only during the time the FM signal is periodically blanked, to adjust the amplitude and phase of signals from the antenna so that a null is formed in the antenna pattern in the direction of unwanted signals and a lobe is formed in the antenna pattern in the direction of the carrier. The null steering apparatus is constructed to maintain the status quo (no adjustments performed) during the time between the blanking periods.

Further, in the present invention the identifier signal may be, for example, a secure PN code which has the properties that it is constantly changing and not predictable. This makes it impossible for anyone transmitting a jamming signal to place the correct identifier on this signal. Since an FM radio is a phase detector and not an amplitude detector, the FM radio is substantially unaffected by the presence of the low level identifier signal.

It is an object of the present invention to provide new and improved null steering apparatus for use in conjunction with a multiple antenna array connected to a FM radio.

It is a further object of the present invention to provide new and improved null steering apparatus for use in conjunction with a multiple antenna array including a new and improved apparatus and method for providing a reference signal to form a lobe in the antenna pattern in the direction of an FM signal received by an FM receiver.

It is a further object of the present invention to provide new and improved null steering apparatus for FM reception wherein an identifier signal is transmitted with the FM signal, and the FM modulation is periodically blanked so that only the carrier signal modulated with the identifier signal is transmitted, which identifier is utilized only during the blanking periods to adjust the null steering apparatus to form a lobe in the antenna pattern in the direction of the FM signal.

These and other objects of this invention will become apparent to those skilled in the art upon consideration of the accompanying specification, claims and drawings.

BRIEF DESCRIPTION OF THE DRAWINGS

Referring to the drawings,

FIG. 3 is a simplified block diagram of an FM transmitter incorporating a portion of the present invention;

FIG. 4*a, b,* and *c* are frequency distribution or spectrum curves illustrating the frequency relationship of various components of the transmitted signal;

FIG. 5 is a vector, or phasor, diagram illustrating the relationship of the FM carrier and the identifier signal; and FIG. 6 illustrates the general waveform of the blanking pulse in the transmitter and the strobe pulse in the receiver.

DESCRIPTION OF THE PREFERRED EMBODIMENT

Figure 1:
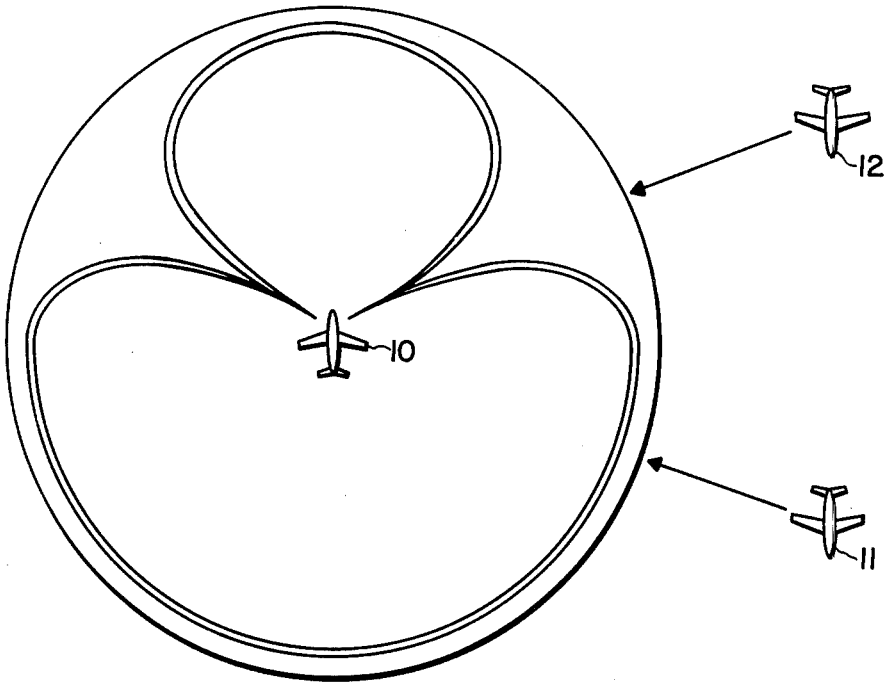
FIG. 1 illustrates a typical antenna pattern for a multiple antenna array incorporating null steering apparatus.

Referring specifically to FIG. 1, an airplane 10 is illustrated carrying a multiple antenna array with null steering apparatus and communications equipment connected thereto. In this specific example, the communications equipment connected to the multiple antenna array is tuned to communicate with a transmitter on a second airplane, designated 11. Jamming signals, for the purpose of frustrating communications between the airplanes 10 and 11, may be transmitted from some source, such as a transmitter on a third airplane 12. The purpose of the multiple antenna array with null steering apparatus is to provide an antenna pattern, typically as shown in FIG. 1, wherein an antenna lobe is directed toward the desired signal from the airplane 11 and an antenna null is directed toward the jamming signal from the airplane 12. In this fashion the jamming signal can be substantially eliminated and the desired signal can be received with very little or no interference. The multiple antenna array with null steering apparatus, located aboard the airplane 10, which provides the antenna pattern illustrated in FIG. 1, is illustrated by the block diagram of FIG. 2. For use in cooperation with the apparatus illustrated in FIG. 2, the transmitter on the airplane 11 is constructed to transmit an identifier signal at the same time that it transmits the desired signal. This identifier signal will be described in more detail in conjunction with FIGS. 2, 3, and 4.

Figure 2:
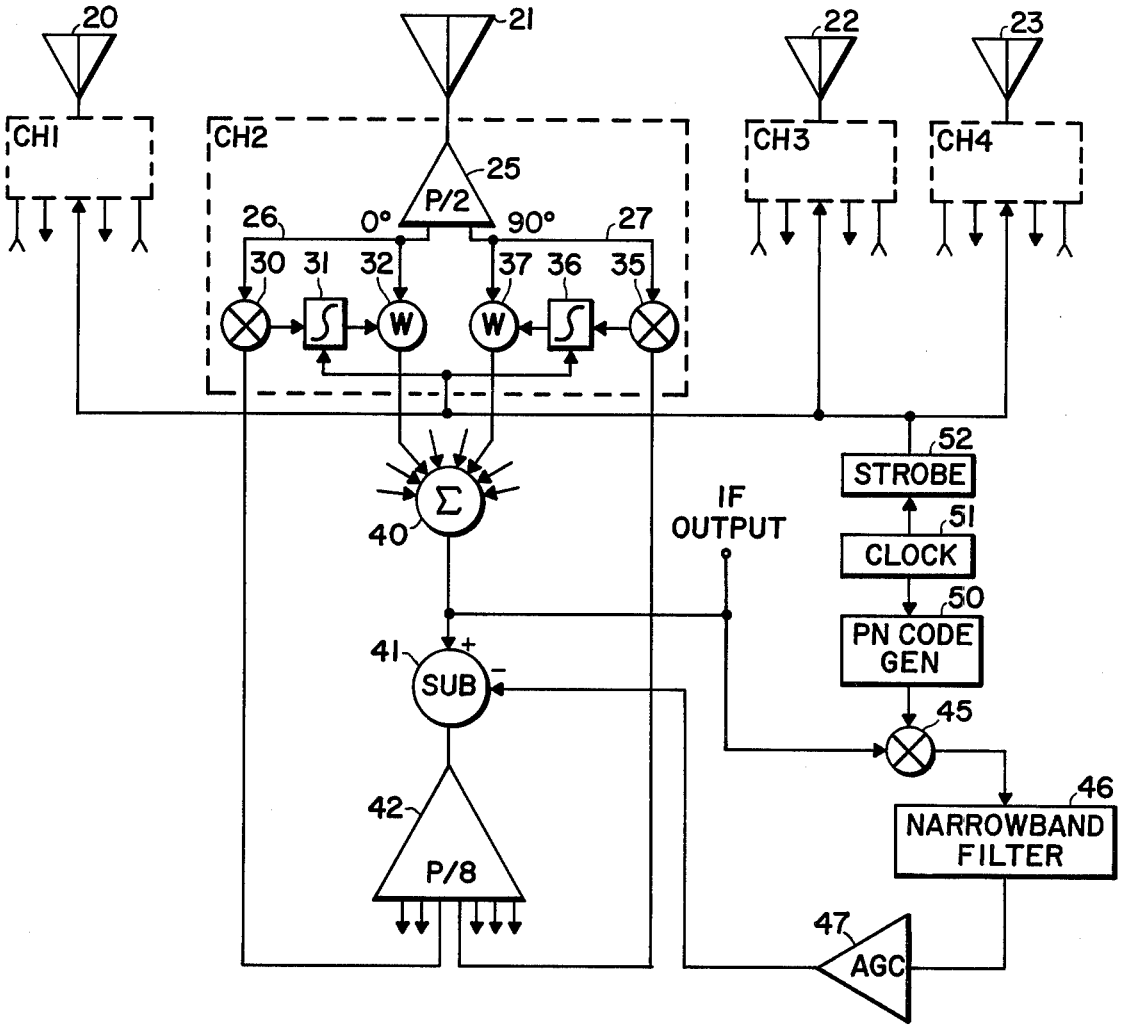
FIG. 2 is a block diagram of a multiple antenna array incorporating null steering apparatus embodying the present invention.

Referring specifically to FIG. 2, a multiple antenna array is illustrated, consisting of four antennas designated 20–23. Any specific signal on any one of the antennas 20–23 can be represented by a phasor and each antenna has associated therewith electronics, designated channel 1 through channel 4, for manipulating the signal so that the phasor has substantially any desired amplitude and phase. Each of the channels 1 through 4 is identical and, therefore, only channel 2 will be described in detail and it should be understood that each of the remaining channels operates in a similar fashion and contains similar apparatus.

A 90° hybrid, or phase splitter, 25 is connected to receive the signals from antenna 21 and supply in-phase and quadrature components thereof on lines 26 and 27, respectively.* The line 26 transmitting the in-phase component, is connected to one input of a correlator, which may be a mixer or multiplier, 30 that provides a signal at an output thereof which is representative of the correlation between the signal applied from the line 26 and a signal applied to a second input of the correlator 30. Output signals from the correlator 30 are integrated in an integrator 31 and applied to a control input of a weighting circuit 32, a second input of which is connected to the line 26. The weighting circuit 32 may be, for example, a variable amplifier or attenuator wherein the signal from the integrator 31 adjusts the amplitude, or weight, of the signal passing through the weighting circuit 32 from the line 26. In a similar fashion, the line 27 is connected to one input of a correlator 35, which correlator 35 has an output connected through an integrator 36 to the control input of a weighting circuit 37. The weighting circuit 37 also has an input connected to the line 27. The correlator 35, integrator 36 and weighting circuit 37 are substantially identical to the correlator 30, integrator 31 and weighting circuit 32, respectively.

*It should be understood that circuitry can be interposed between the antennas and the phase splitters to alter the frequency of the incoming signal, e.g., IF type circuitry.

The outputs of the weighting circuits 32 and 37, as well as similar outputs from channels 1, 3 and 4, are applied to a summing circuit 40. The summing circuit 40 has a single output which is connected to one input of a subtractor circuit 41 with a single output which is applied through a power splitter 42 to each of the second inputs of the correlators 30, 35, and the two correlators in each of the channels 1, 3 and 4. The output of the summing circuit 40 is also applied as an IF input to an FM communications receiver (not shown). Also, the output of the summing circuit 40 is connected to one input of a decoder, or mixer, 45. A second input of the decoder 45 is connected to receive an internally generated PN code from a PN code generator 50. The PN code generator 50 is synchronized by means of an internal clock 51. The clock 51 may be, for example, a relatively accurate oscillator which is synchronized with a similar clock or oscillator in the transmitter at the beginning of the flight and which remains synchronized throughout the flight. The clock 51 may also be synchronized with a clock in the transmitter by transmitting periodic pulses or in any of the other well known means. An output of the decoder 45 is connected through a narrow band filter 46 to an AGC amplifier 47. The output signal from the suming circuit 40 is in-phase with the transmitted carrier and care should be taken in the design of the mixer 45, filter 46 and amplifier 47 to ensure that the output signal from the amplifier 47 is still in-phase with the transmitted carrier signal. A second output of the clock 51 is applied to a strobe circuit 52, which may be a monostable circuit or the like. An output of the strobe circuit 52 is connected to each of the integrators in each of the channels 1–4, e.g., integrators 31 and 36 in channel 2.

Referring specifically to FIG. 3, a transmitter, such as the transmitter located on the airplane 11 in FIG. 1, transmits an FM signal, or frequency modulated carrier, and simultaneously the transmitted carrier is modulated with a low level identifier signal substantially in-phase with the FM carrier, which in this specific embodiment is a secure PN code. The frequency and phase relationship of the FM signal and the PN code are illustrated in FIGS. 4*c* and 5, respectively. To provide these signals a carrier oscillator 60 provides a carrier signal to a power splitter 61, which supplies a first output to a frequency modulator 62 and a second output to a mixer 63. The first and second outputs of the power splitter 61 are both the same phase. Audio is applied through a blanking circuit 65 to the FM modulator 62 and the output of the modulator 62 is applied to a summing circuit 66. A PN code is applied to a second input of the mixer 63 and the coded output is applied through a 6dB attenuator 67 to a second input of the summing circuit 66. The output of the summing circuit 66 is applied through the usual power amplifiers 70 of a transmitter to a transmitting antenna 71.

The blanker 65 periodically removes audio from the modulator 62 for a short period of time so that only the carrier modulated with the identifier signal, issuing from the attenuator 67, is transmitted. The waveform of FIG. 6 illustrates the approximate blanking pulses utilized in the present embodiment so that, as illustrated, the carrier signal modulated by the identifier signal is transmitted for one microsecond out of ten and the frequency modulated carrier is transmitted for nine microseconds out of ten. The effect of this blanking on audio modulation is nearly imperceptable because of the short duration of the blanking pulse. The effect on the FM spectrum, however, is to concentrate all the transmitter power into the FM carrier for the duration of the blanking pulse. The energy in an FM signal is substantially constant for all modulations. When no modulation is present, all of the energy is concentrated in the carrier (see FIG. 4*a*). When modulation is present the majority of the energy is in the sidebands. Since the total energy is constant, the energy in the sidebands must be obtained by using most of the energy that was in the carrier which renders the carrier energy very small when modulation is present (see FIG. 4*b*). In the present embodiment the PN code is placed in-phase and at a low level on the carrier signal throughout the transmission. The PN code affects the amplitude of the FM signal, but not the phase (see FIG. 5). Since an FM radio is a phase detector and not an amplitude detector, the FM radio is unaffected by the presence of the low level PN code. It should be understood, however, that the identifier signal (the PN code in this embodiment) might, instead of operating continuously, be turned on when the audio is turned off.

In the operation of the null steering apparatus of FIG. 2, signals from the antenna 21 are split into an in-phase component and a quadrature component in the phase splitter the two signal components are then weighted by the weighting circuits 32 and 37 and summed together, along with the signals from the other antenna weighters, in the summing circuit 40. The values of the weighting circuits 32 and 37 are automatically adjusted by feeding back the output of the summing circuit 40 through the subtractor 41 and power splitter 42 to the correlators 30 and 35. The feedback signal is correlated with the non-weighted signal from the phase shifter 25 to create a correlation voltage which is integrated and used to drive the weighting circuits 32 and 37. The weighting circuits 32 and 37 are always driven in such a manner as to minimize the feedback signal. When the feedback signal is completely eliminated, corresponding to forming a complete null, the output of the correlators 30 and 35 is zero and the system has fully adapted. A null steerer implemented in this manner will null out all signals as long as the number of signals is equal to or less than N-1, where N is the number of antennas.

A signal present at the antenna can be represented by a phasor and the phase splitter 25 and weighting circuits 32 and 37 are utilized to shift the phasor to any phase and amplitude desired. For example, if a jamming signal is present on antennas 20 and 21, the null steerer will shift the two signals (phasors) such that they are of equal amplitude and opposite phase. When these two weighted signals are then summed together in the summing circuit 40, they will cancel, thereby forming an antenna pattern null in the direction of the jamming signal, as illustrated in FIG. 1. The process is similar when the jamming signal is present on all four antennas.

The reference signal applied to the subtracting circuit 41 prevents nulling out the carrier signal. By subtracting the reference signal in the subtracting circuit 41, the carrier signal is not fed back to the correlators 30 and 35 and, since the carrier signal is not present at the correlators 30 and 35, no null will be formed thereon and a lobe will be formed in the antenna pattern in the direction of the FM carrier signal. The important point to be understood is that the system has fully adapted only when the feedback signal is zero. Therefore, if the power output from the AGC amplifier 47, i.e., the reference signal power output, equals the FM carrier signal output power from the summing circuit 40 the output of the subtracting circuit 41, which is the feedback signal to the correlators 30 and 35, will be equal to zero and a lobe will be formed on the FM carrier signal.

The bandwidth of the filter 46 is just wide enough to pass the frequency uncertainity of the carrier signal. The decoder or mixer 45 receives the carrier modulated with the PN code and injects an internally generated PN code from the generator 50, which is exactly the same as the transmitted PN code so that only a CW (continuous wave) signal in-phase with the carrier signal is available at the output thereof. Any system attempting to decode the transmitted signal without the correct PN code will have a signal at the output of the decoder with a frequency spectrum similar to white noise, as illustrated in FIG. 4*c* and labelled PN. Since the uncoded signal has a very wide bandwidth, it will not pass through the narrow band filter 46 and the uncoded signal will eventually be nulled out in the null steering apparatus. If the internally generated PN code applied to the mixer 45 is the correct code, the CW signal at the output of the mixer 45 will be a signal at the same frequency and phase as the transmitted carrier and the signal will pass readily through the filter 46. This referenc signal, which is a replica of the transmitted carrier is then applied to the subtracting circuit 41. While the terms "transmitted carrier" and "carrier signal" are used in this disclosure, it should be understood that the terms are meant to include not only the carrier actually transmitted but any other signals, e.g., IF signals, to which the transmitted signal is converted before being applied to the present circuit.

The strobe 52 activates the integrators 31, 36, etc., only during the blanking pulses, or in synchronism with the removal of audio (FM modulation) from the transmitted carrier. Thus, the null steerer is allowed to adapt only during the period of time that the modulation is blanked out. During this period, the desired signal spectrum, or transmitted signal, consists only of an FM carrier signal. The reference signal producing means needs only to provide, at the output of the AGC amplifier 47, a reference signal of the same frequency and phase as that of the FM carrier signal in order to successfully subtract off the FM carrier signal in the subtractor circuit 41. Since there is no straight forward way to estimate the spectral energy in an FM signal, because the spectrum is totally determined by the instantaneous modulation which is unknown to the receiver, it is necessary to periodically remove the modulation and adjust the feedback circuitry to form a lobe on the FM carrier signal. The feedback circuit is designed with sufficient memory or storage, for example in the integrators 31 and 36, to maintain substantially the existing adjustment between blanking pulses, or activating periods, so that once the null steerer forms a lobe on the FM carrier the lobe will be maintained in that direction after the carrier is again modulated by audio.

Since the PN code, or identifier signal, is placed in-phase on the carrier and at a relatively low level and since the FM receiver is a phase detector and not an envelope detector, the FM receiver is substantially unaffected by the presence of the low level identifier or PN code signal. This can be seen by the vector or phasor diagram in FIG. 5 where it is clear that the phase of the in-phase signal (the FM signal along the zero degree axis) is substantially unaffected by the PN code signal in-phase therewith. The code rate is selected so that most of the spectral energy passes through the narrow band IF filter 46. Since forming a lobe in the antenna pattern in the direction of the FM carrier signal without modulation will include the FM carrier signal with modulation, when the blanking pulse is removed, it is not necessary to produce a reference signal which includes all of the modulation. Because the reference signal is a CW signal of the exact frequency and phase as the transmitted carrier signal of the desired FM signal, the carrier of the FM signal can be subtracted from the output of the summing circuit 40 and, therefore, be eliminated from the feedback signal to the correlators 30 and 35. However, because the feedback loop is open between blanking pulses it will only adapt during the blanking pulses. The transmitted PN code will be present in the feedback signal but this component of the desired signal does not contain sufficient energy to form a null.

Therefore, through the use of the present null steering apparatus a reference signal is produced which is a CW signal of the same frequency and phase as the carrier of the FM signal and is utilized to form a lobe in the antenna pattern in the direction of the FM signal. Only the carrier signal with the identifier signal modulated thereon is transmitted during periodic blanking pulses and the null steering apparatus adapts during the blanking pulses so that the lobe is formed on the carrier signal and the status quo is maintained when the blanking pulses are removed so that the lobe is still directed toward the desired FM signal. It will be apparent to those skilled in the art that different identifier signals, which are in-phase with the carrier signal, might be utilized and that different apparatus might be utilized for picking off the identifier signal and for generating a CW signal having the same frequency and phase as the carrier. While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. A communications system comprising:

a. a transmitter providing a carrier signal;

b. frequency modulating means connected to said transmitter for frequency modulating the carrier signal in accordance with a desired message;

c. identifier modulating means coupled to said transmitter for modulating on the carrier signal a relatively low level identifier signal substantially in-phase with the carrier signal;

d. blanking means coupled to said frequency modulating means for periodically blanking the frequency modulation for a relatively short period so that only the carrier modulated with the identifier signal is transmitted; and e. a receiver having a multiple antenna array connected thereto and null steering apparatus including:

1. feedback means associated with each antenna in said array for adjusting the amplitude and phase of signals therein so that unwanted signals from the array are cancelled.

2. reference signal producing means coupled to said feedback means for picking off the identifier signal and utilizing the identifier signal to generate a reference signal having the same frequency and phase as the carrier signal, 3. switching means coupled to said feedback means for activating said feedback means only during the time the FM signal is periodically blanked, said feedback means maintaining substantially the existing adjustment between activated periods, and 4. compensating means coupled to said feedback means for utilizing the reference signal to form a lobe in the antenna pattern in the direction of the carrier signal having the FM signal modulated thereon.

2. In a multiple antenna array, null steering apparatus for reception of a carrier signal having modulated thereon an FM signal and a relatively low level identifier signal substantially in-phase with the carrier signal, the FM signal being periodically blanked for a relatively short period so that only the carrier signal modulated with the identifier signal is transmitted, said null steering apparatus comprising:

a. feedback means associated with each antenna in said array for separating signals coupled from the antenna, representable as phasors, into in-phase and quadrature components and adjusting the in-phase and quadrature components to alter the amplitude and phase of the phasors so that unwanted signals from the array are cancelled;

b. reference signal producing means coupled to said feedback means for picking off the identifier signal and utilizing the identifier signal to generate a reference signal having the same frequency and phase as the carrier signal;

c. switching means coupled to said feedback means for activating said feedback means only during the time the FM signal is periodically blanked, said feedback means maintaining substantially the existing adjustment between activated periods; and d. compensating means coupled to said feedback means for utilizing the reference signal to form a lobe in the antenna pattern in the direction of the carrier signal having the FM signal modulated thereon.

3. Null steering apparatus as claimed in claim 2 wherein the identifier siganl is a PN code signal and the reference signal producing means includes PN decoder means coupled to the feedback means for picking off the PN code signal and converting the PN code signal to a CW signal.

4. Null steering apparatus as claimed in claim 4 including in addition clock means coupled to the PN decoder means and the switching means for synchronizing the PN decoder means and the switching means with the modulated carrier signal.

5. In a communications system including a transmitter for transmitting a carrier signal having modulated thereon an FM signal and a relatively low level identifier signal substantially in-phase with the carrier signal, the FM signal being periodically blanked for a relatively short period so that only the carrier signal modulated with the identiifer signal is transmitted, and a receiver having a multiple antenna array attached thereto, a method of null steering the array comprising the steps of:

a. adjusting the amplitude and phase of signals coupled from the antennas so that a null is formed in the antenna pattern in the direction of unwanted signals during the time the FM signal is periodically blanked;

b. maintaining substantially the existing adjustment between the periods that the FM signal is blanked;

c. separating the identifier signal from the FM signal modulated carrier signal and generating, therefrom, a reference signal having the same frequency and phase as the carrier signal; and d. utilizing the reference signal in the step of adjusting the amplitude and phase of signals coupled from the antennas between the periods that the FM signal is blanked.

* * * * *